US012543851B1

(12) United States Patent
Mink et al.

(10) Patent No.: US 12,543,851 B1
(45) Date of Patent: Feb. 10, 2026

(54) LUGGAGE RACK ACCESSORY

(71) Applicants: Jennifer Mink, Yardley, PA (US); Laura Farber, Henderson, NV (US)

(72) Inventors: Jennifer Mink, Yardley, PA (US); Laura Farber, Henderson, NV (US)

( * ) Notice: Subject to any disclaimer, the term of this patent is extended or adjusted under 35 U.S.C. 154(b) by 108 days.

(21) Appl. No.: 18/413,148

(22) Filed: Jan. 16, 2024

(51) Int. Cl.
*A47B 43/04* (2006.01)

(52) U.S. Cl.
CPC ..... *A47B 43/04* (2013.01)

(58) Field of Classification Search
CPC ..... A47B 43/04; A47B 43/00; A47B 61/06; A47B 61/02; A47B 3/12; A47B 2003/045; A47C 5/04; A47C 4/24
USPC ..... 312/258; 108/115, 118, 99, 100, 25, 26, 108/167, 93, 90; 16/232; 297/239, 339; 211/202, 201, 85.3, 85; 248/128, 164, 248/432, 188.1, 188
See application file for complete search history.

(56) References Cited

U.S. PATENT DOCUMENTS 102,717 A 5/1870 Yven
486,602 A * 11/1892 Morton
1,211,286 A * 1/1917 Carney ..... A47B 43/006 108/166
1,420,534 A * 6/1922 Everitt ..... A47B 61/02 211/85.3
2,009,721 A * 7/1935 Williams ..... F16B 47/00 248/362
2,115,323 A * 4/1938 Wuest ..... B60N 3/007 108/167
2,727,564 A * 12/1955 Gruber ..... A47C 5/04 297/339
3,148,924 A * 9/1964 Habler ..... A47B 31/001 248/128
3,766,844 A * 10/1973 Donnelly ..... F24F 3/167 454/238
4,262,606 A * 4/1981 Hodson ..... A47B 3/12 108/162
4,580,750 A * 4/1986 Spellman ..... F16M 11/2021 108/118
4,974,525 A * 12/1990 Sheffield ..... A47B 3/12 108/118
5,146,635 A * 9/1992 Gastle ..... A61D 3/00 119/757
D451,304 S 12/2001 Felsenthal
11,464,329 B1 10/2022 Levy
11,638,480 B2 * 5/2023 Felsenthal ..... A47B 43/003 211/85
11,713,996 B2 8/2023 Smith
(Continued)

FOREIGN PATENT DOCUMENTS

CN 206947495 U * 1/2018
CN 219047751 U * 5/2023
(Continued)

*Primary Examiner* — Janet M Wilkens

(57) ABSTRACT

The luggage rack accessory includes a woven platform on foldable clam shell structure that is utilized in conjunction with an existing luggage pedestal to support a luggage item. The woven platform attaches to the clamshell structure to form a load bearing surface. The luggage pedestal elevates the load bearing surface. The load bearing surface receives the luggage item. The load bearing surface transfers the load of the luggage item to the luggage pedestal.

5 Claims, 8 Drawing Sheets

(56) References Cited

U.S. PATENT DOCUMENTS

| | | | | |
|---|---|---|---|---|
| 2005/0091792 | A1* | 5/2005 | Cohen | E05D 11/1007 16/232 |
| 2008/0035391 | A1 | 2/2008 | Jewett | |
| 2023/0101062 | A1 | 3/2023 | Bailey | |

FOREIGN PATENT DOCUMENTS

| | | | | |
|---|---|---|---|---|
| GB | 2423500 | | 4/2005 | |
| WO | WO-2024049437 | A1 * | 3/2024 | A47B 43/00 |

* cited by examiner

LUGGAGE RACK ACCESSORY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of folding shelf units. (A47B43/00)

SUMMARY OF INVENTION

The luggage rack accessory comprises a woven platform on foldable clam shell structure that is utilized in conjunction with an existing luggage pedestal to support a luggage item. The woven platform attaches to the clamshell structure to form a load bearing surface. The luggage pedestal elevates the load bearing surface. The load bearing surface receives the luggage item. The load bearing surface transfers the load of the luggage item to the luggage pedestal.

These together with additional objects, features and advantages of the luggage rack accessory will be readily apparent to those of ordinary skill in the art upon reading the following detailed description of the presently preferred, but nonetheless illustrative, embodiments when taken in conjunction with the accompanying drawings.

In this respect, before explaining the current embodiments of the luggage rack accessory in detail, it is to be understood that the luggage rack accessory is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the luggage rack accessory.

It is therefore important that the claims be regarded as including such equivalent construction insofar as they do not depart from the spirit and scope of the luggage rack accessory. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
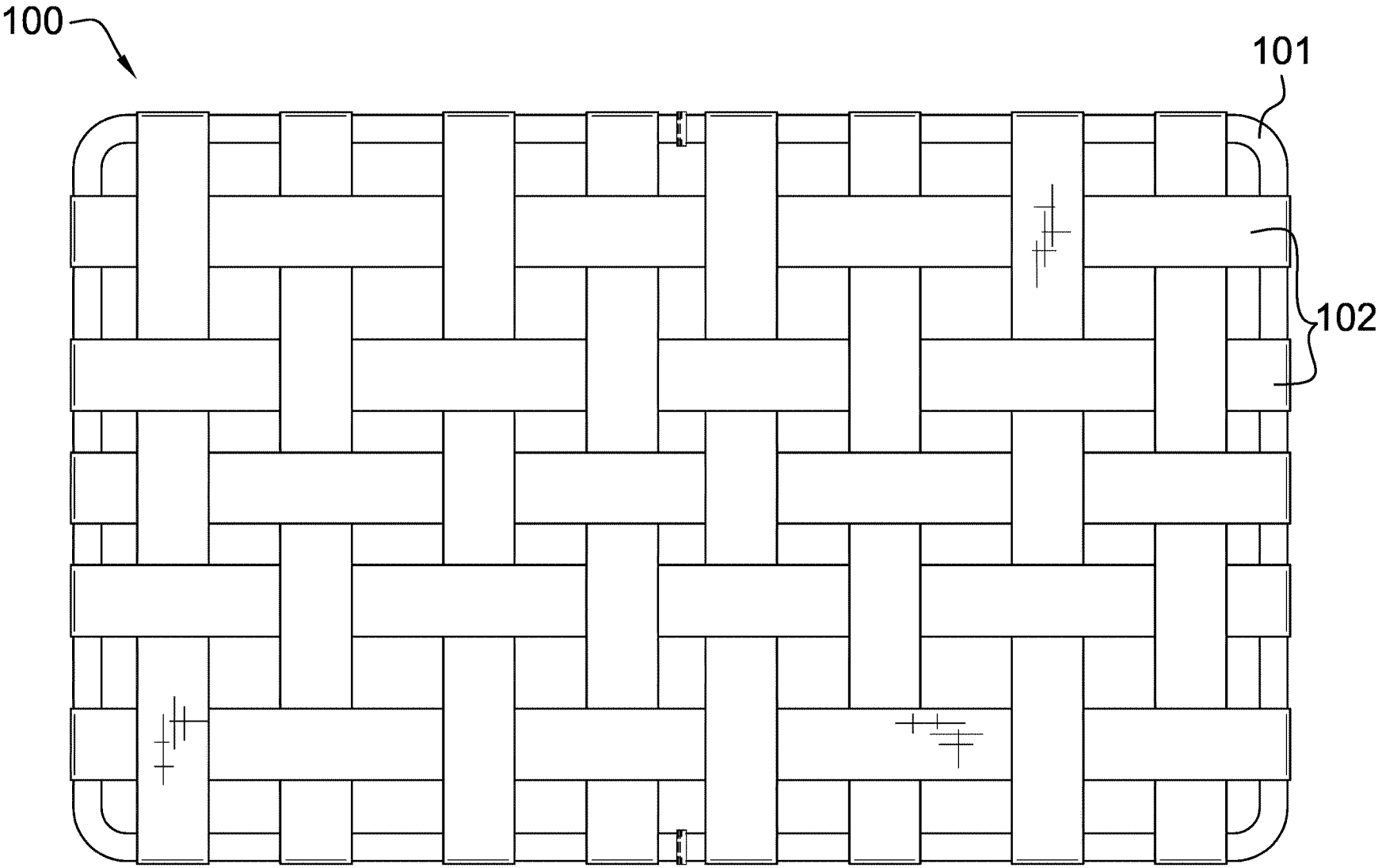
FIG. 1 is a superior view of an embodiment of the disclosure.
Figure 2:
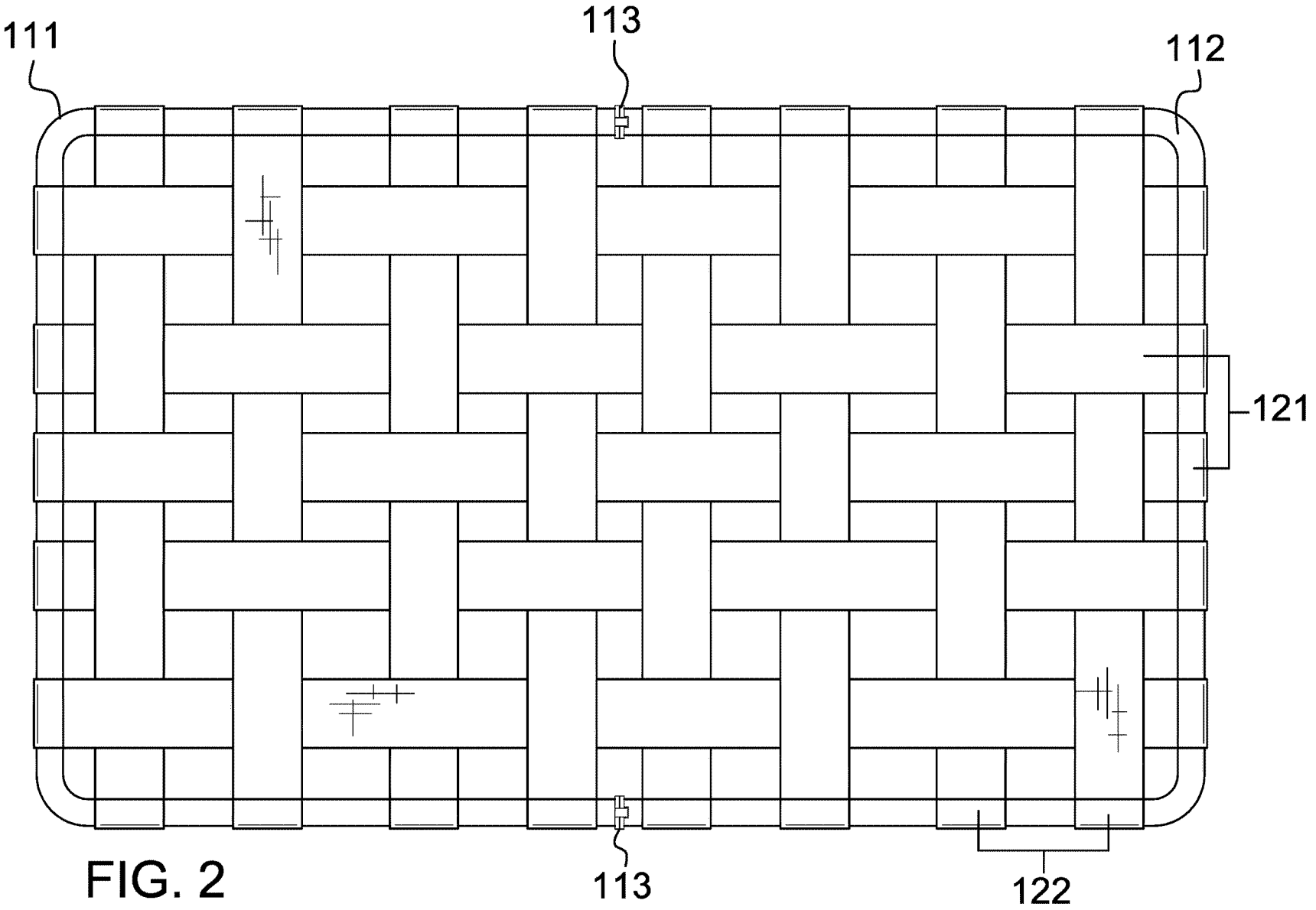
FIG. 2 is an inferior view of an embodiment of the disclosure.
Figure 3:
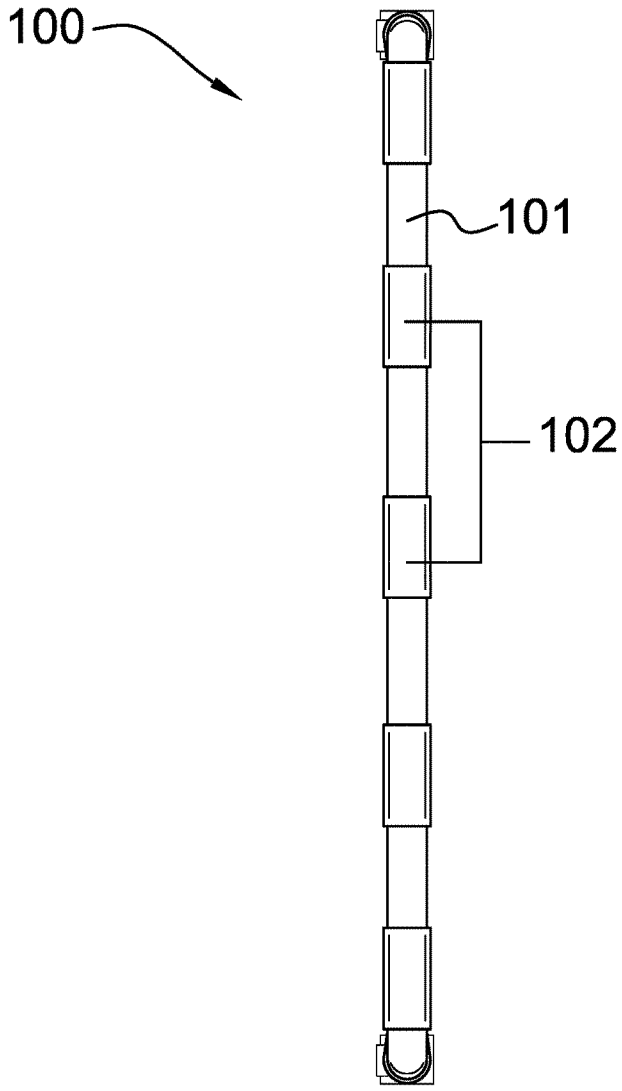
FIG. 3 is a lateral view of an embodiment of the disclosure.
Figure 4:
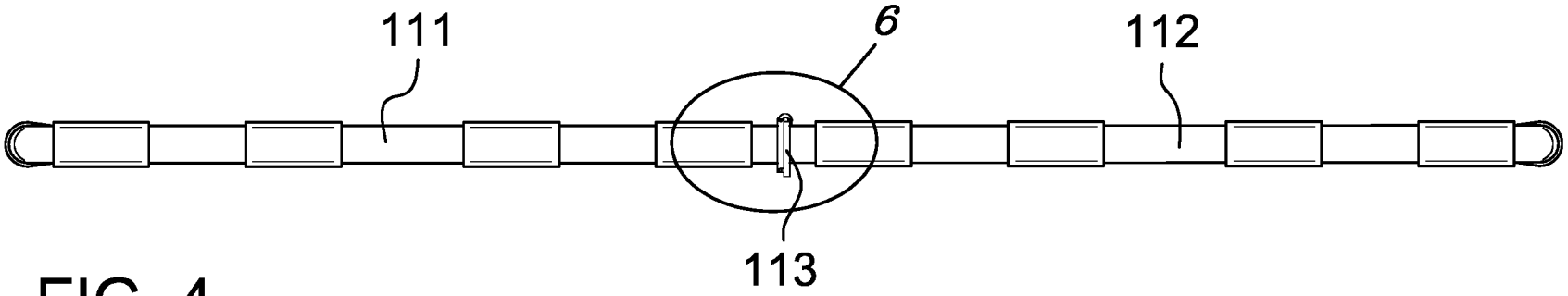
FIG. 4 is a lateral view of an embodiment of the disclosure.
Figure 5:
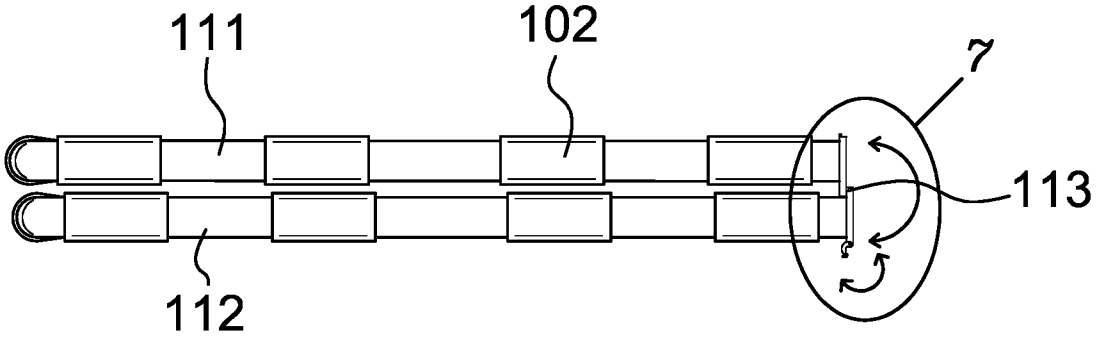
FIG. 5 is a closed lateral view of an embodiment of the disclosure.
Figure 7:
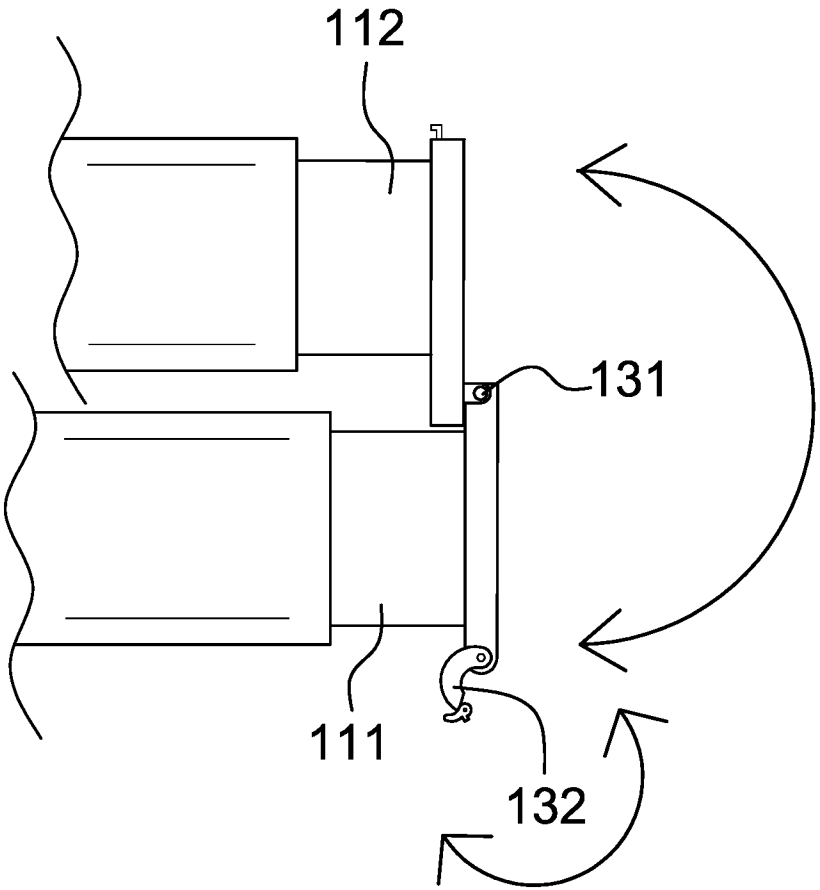
FIG. 7 is a detail view of an embodiment of the disclosure.
Figure 6:
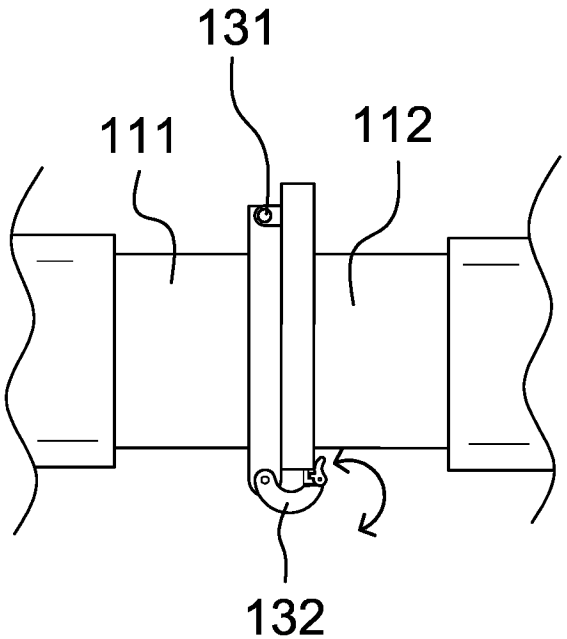
FIG. 6 is a detail view of an embodiment of the disclosure.
Figure 8:
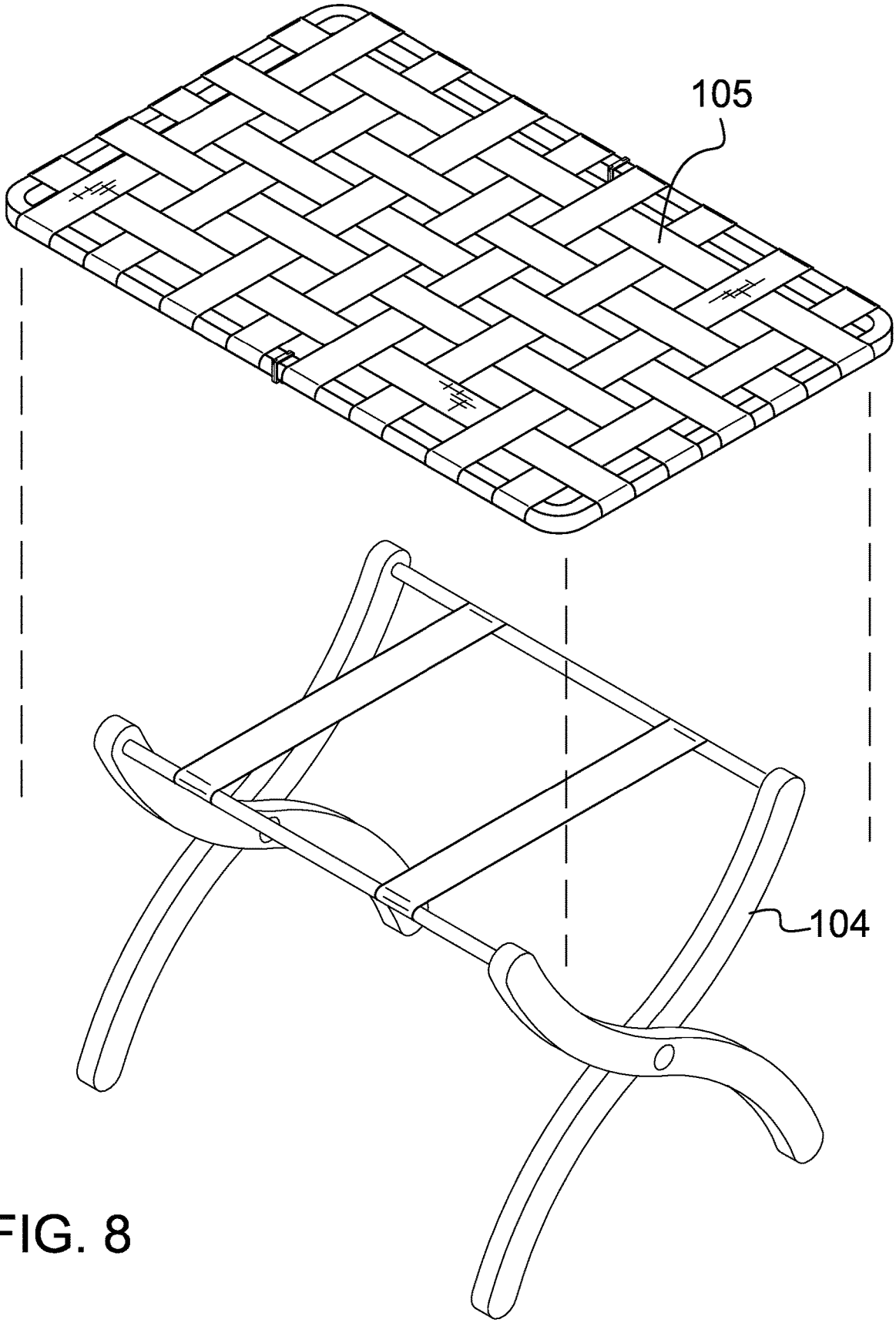
FIG. 8 is an in-use view of an embodiment of the disclosure.
Figure 9:
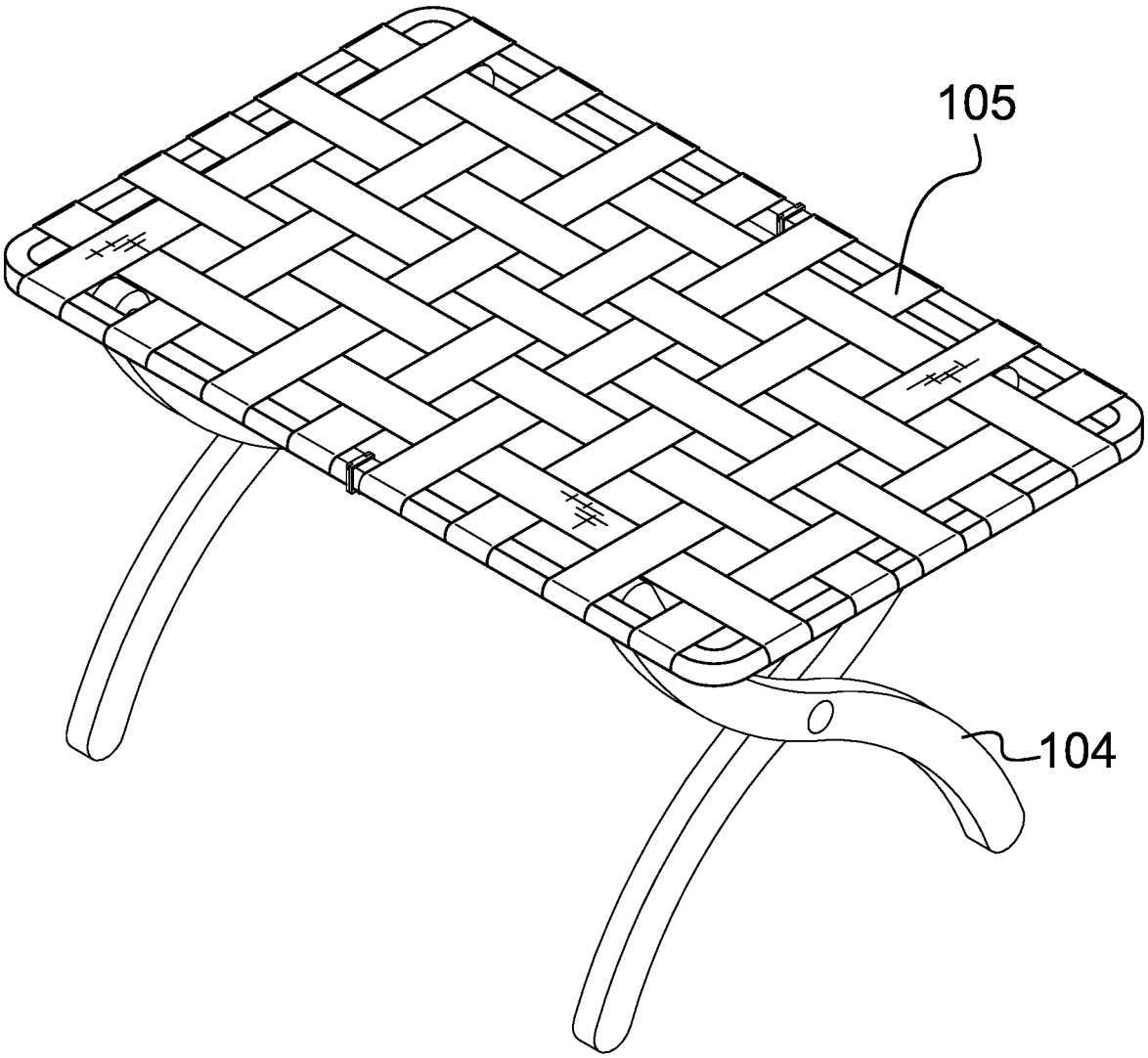
FIG. 9 is an in-use view of an embodiment of the disclosure.
Figure 10:
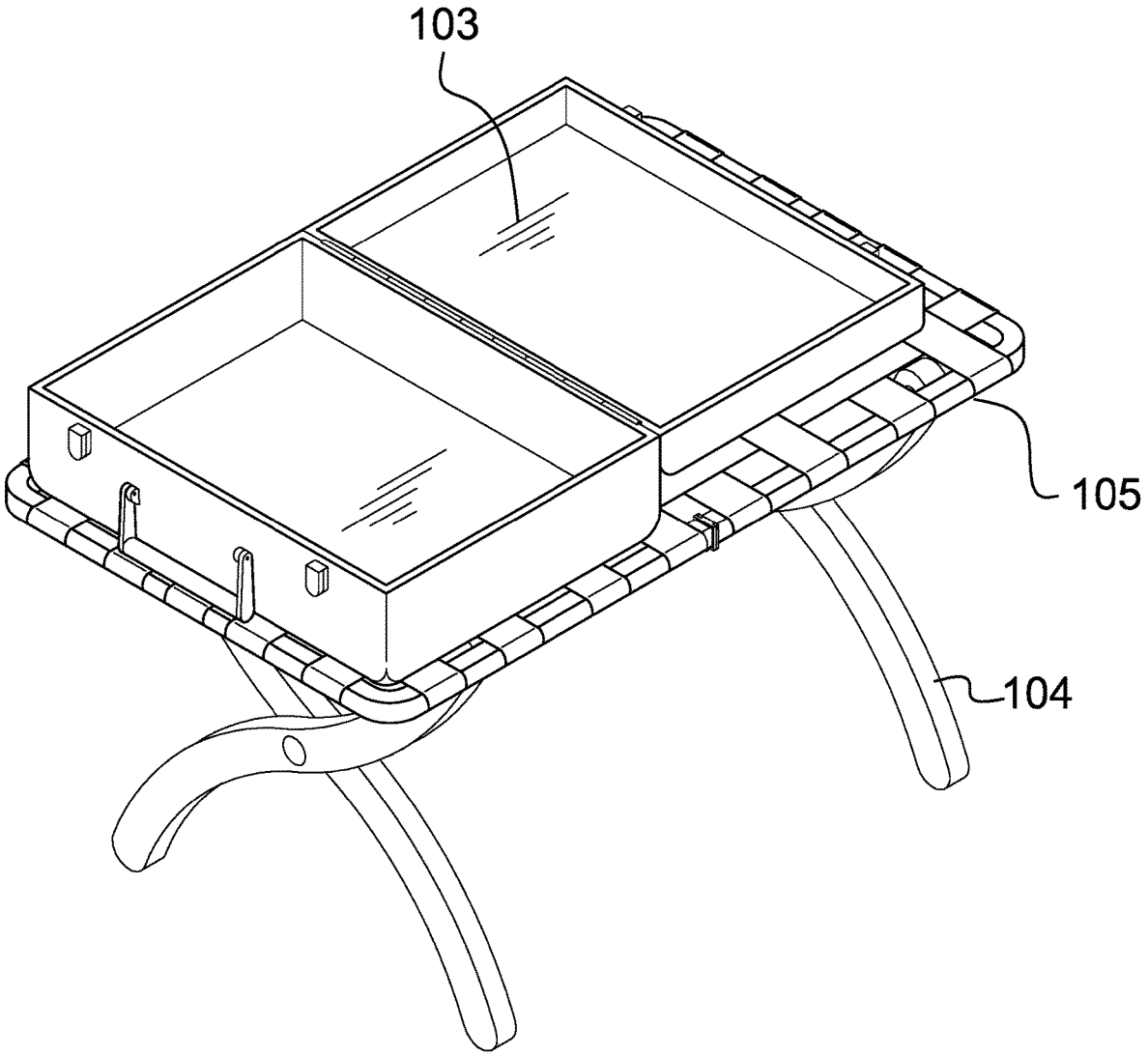
FIG. 10 is an in-use view of an embodiment of the disclosure.

Detailed reference will now be made to one or more potential embodiments of the disclosure, which are illustrated in FIGS. 1 through 10.

The luggage rack accessory 100 (hereinafter invention) comprises a clamshell structure 101, a woven platform 102, a luggage item 103, and a luggage pedestal 104. The woven platform 102 attaches to the clamshell structure 101 to form a load bearing surface 105. The luggage pedestal 104 elevates the load bearing surface 105. The load bearing surface 105 receives the luggage item 103. The load bearing surface 105 transfers the load of the luggage item 103 to the luggage pedestal 104.

The luggage item 103 is a container used to transport domestic articles during travel. The luggage pedestal 104 is a mechanical structure. The luggage pedestal 104 is a load bearing structure. The luggage item 103 mounts on the superior surface of the luggage pedestal 104. The luggage pedestal 104 elevates the luggage item 103 above a supporting surface.

The clamshell structure 101 is a mechanical structure. The clamshell structure 101 is a load bearing structure. The clamshell structure 101 is a collapsible structure. The clamshell structure 101 is a rotating structure. The clamshell structure 101 rotates between a closed position and an open position. In the closed position, the clamshell structure 101 rotates to form a composite prism structure. In the open position, the clamshell structure 101 rotates to form a lateral disk structure.

The clamshell structure 101 removably mounts on the superior surface of the luggage pedestal 104. The clamshell structure 101 forms the framework the woven platform 102 mounts on. The clamshell structure 101 transfers the loads of the woven platform 102 and the luggage item 103 to the luggage pedestal 104.

The clamshell structure 101 comprises a first frame ring 111, a second frame ring 112, and a hinge structure 113.

The first frame ring 111 is a disk shaped structure. The first frame ring 111 has a ring shape. The first frame ring 111 forms a portion of the perimeter of the openwork structure of the clamshell structure 101.

The second frame ring 112 is a disk shaped structure. The second frame ring 112 has a ring shape. The second frame ring 112 forms the balance of the perimeter of the openwork structure of the clamshell structure 101.

The second frame ring 112 attaches to the first frame ring 111 such that the second frame ring 112 rotates relative to the first frame ring 111. The second frame ring 112 rotates between the closed position and the open position. The second frame ring 112 is geometrically identical to the first frame ring 111. The second frame ring 112 attaches to the first frame ring 111 such that the second frame ring 112 aligns with the first frame ring 111 in the closed position. The alignment of the second frame ring 112 with the first frame ring 111 forms the clamshell shape of the clamshell structure 101 in the closed position. The second frame ring 112 attaches to the first frame ring 111 such that the second frame ring 112 and the first frame ring 111 forms a lateral disk structure in the open position.

The hinge structure 113 is a fastening device. The hinge structure 113 is a rotating device. The hinge structure 113 forms a locking hinge. The hinge structure 113 attaches the second frame ring 112 to the first frame ring 111 such that the second frame ring 112 rotates between the closed position and the open position. The hinge structure 113 locks the clamshell structure 101 into a fixed position when the clamshell structure 101 is in a closed position.

The hinge structure 113 further comprises a hinge pin 131 and a hinge latch 132. The hinge pin 131 is a pivot. The hinge pin 131 forms the mechanical structure that secures the second frame ring 112 to the first frame ring 111. The hinge pin 131 provides the mechanism that allows the second frame ring 112 to rotate relative to the first frame ring 111. The hinge latch mechanical structure. The hinge latch 132 forms a latch that releasably locks the clamshell structure 101 into the closed position.

The woven platform 102 forms a horizontally oriented load bearing surface 105. The woven platform 102 forms a platform that receives the luggage item 103. The woven platform 102 is a woven structure. The woven platform 102 is an openwork structure. The woven platform 102 is a load bearing structure. The woven platform 102 receives the load of the luggage item 103. The woven platform 102 transfers the load of the luggage item 103 to the clamshell structure 101.

The woven platform 102 is a flexible structure. The woven platform 102 is a textile based structure. The woven platform is webbing based structure. The webbings of the woven platform 102 are interlaced to form the horizontally oriented load bearing surface 105. The woven platform 102 is a foldable structure. The foldable structure of the woven platform 102 allows the woven platform 102 to fold onto itself when the clamshell structure 101 rotates into the closed position. The woven platform 102 forms the horizontally oriented load bearing surface 105 when the clamshell structure 101 rotates into the open position.

The openwork structure of the woven platform 102 encloses the characteristic aperture of the ring structure of the first frame ring 111. The openwork structure of the woven platform 102 encloses the characteristic aperture of the ring structure of the second frame ring 112.

The woven platform 102 comprises a plurality of major webbing structures 121 and a plurality of minor webbing structures 122.

Each webbing structure selected from the plurality of major webbing structures 121 is a textile based structure. Each webbing structure selected from the plurality of major webbing structures 121 is a flexible structure. Each webbing structure selected from the plurality of major webbing structures 121 is a webbing. Each webbing structure selected from the plurality of major webbing structures 121 is a load bearing structure. The span of the length of the major axis of each webbing structure selected from the plurality of major webbing structures 121 is identical.

Each webbing structure selected from the plurality of major webbing structures 121 is formed with a first free end and a second free end. The first free end of each webbing structure selected from the plurality of major webbing structures 121 is the edge of the lateral face of the selected webbing structure with the least span of length. The second free end of each webbing structure selected from the plurality of major webbing structures 121 is the edge of the lateral face of the selected webbing structure that is distal from the first free end.

The first free end of each webbing structure selected from the plurality of major webbing structures 121 attaches to an edge of the perimeter of the clamshell structure 101. The second free end of each webbing structure selected from the plurality of major webbing structures 121 attaches to the edge of the perimeter of the clamshell structure 101 that is distal from the perimeter edge the first free end attaches to.

The plurality of major webbing structures 121 attach to the clamshell structure 101 such that the major axes of each webbing structure selected from the plurality of major webbing structures 121 are parallel.

Each webbing structure selected from the plurality of minor webbing structures 122 is a textile based structure. Each webbing structure selected from the plurality of minor webbing structures 122 is a flexible structure. Each webbing structure selected from the plurality of minor webbing structures 122 is a webbing. Each webbing structure selected from the plurality of minor webbing structures 122 is a load bearing structure.

The span of the length of the major axis of each webbing structure selected from the plurality of minor webbing structures 122 is identical. The span of the length of the major axis of each webbing structure selected from the plurality of minor webbing structures 122 is less than the span of the length of the major axis of each webbing structure selected from the plurality of major webbing structures 121.

Each webbing structure selected from the plurality of minor webbing structures 122 is formed with a third free end and a fourth free end. The third free end of each webbing structure selected from the plurality of minor webbing structures 122 is the edge of the lateral face of the selected webbing structure with the least span of length. The fourth free end of each webbing structure selected from the plurality of minor webbing structures 122 is the edge of the lateral face of the selected webbing structure that is distal from the third free end. The third free end of each webbing structure selected from the plurality of minor webbing structures 122 attaches to an edge of the perimeter of a structure selected from the group consisting of: a) the first frame ring 111 of the clamshell structure 101; and, b) the second frame ring 112 of the clamshell structure 101. The fourth free end of each webbing structure selected from the plurality of minor webbing structures 122 attaches to the edge of the perimeter of the selected structure that is distal from the perimeter edge the third free end attaches to.

The plurality of minor webbing structures 122 attach to the clamshell structure 101 such that the major axes of each webbing structure selected from the plurality of minor webbing structures 122 are parallel.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Clamshell: As used in this disclosure, clamshell refers to the relationship between a first structure and a second structure such that: 1) a hinge joins the first structure to the second structure; and, 2) the second structure is oriented to the first structure such that the first structure and the second structure form a mirror image.

Closed Position: As used in this disclosure, a closed position refers to a movable structure that is in an orientation that minimizes the perimetrical boundary presented by the movable structure. The closed position is often referred to as an object being "closed."

Collapsible: As used in this disclosure, the terms collapsible refers to an object that is configured such that the volume of the object is adjustable. By volume is meant the volume of the perimetrical boundary that contains the object. The verbs collapse and retract mean that the volume of the perimetrical boundary of the object changes from a larger volume to a smaller volume. The verbs expand and deploy mean that the volume of the perimetrical boundary of the object changes from a smaller volume to a larger volume.

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Framework: As used in this disclosure, a framework refers to the substructure of an object that forms a load path for the object.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Interlace: As used in this disclosure, to interlace means to align a series of linear objects selected in an alternating manner. The linear objects are selected from two or more groups of linear objects. The alternating manner is a function of the group the linear object is identified with.

Latch: As used in this disclosure, a latch is a fastening or locking mechanism commonly used to secure a rotating structure into a closed position.

Lateral Disk Structure: As used in this disclosure, a lateral disk structure refers to the juxtaposition of a first lateral face of a first disk-shaped structure to a second lateral face of a second disk-shaped structure such that: a) the center axes of the first disk and the second disk are parallel; and, b) the congruent ends of the first disk are parallel to the congruent ends of the second disk. The span of the length of the center axes of the first disk and the second disk need not be equal. The form factor of the congruent ends of the first disk and the second disk need not be geometrically similar.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Lock: As used in this disclosure, a lock is a releasable fastening device that secures a rotating mechanical device into a fixed position.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure.

In both cases, the space formed within the first linear structure is such that a second linear structure such as a line, cord or a hook can be inserted through the space formed within the first linear structure. Within this disclosure, the first linear structure is said to be looped around the second linear structure.

Luggage: As used in this disclosure, luggage is a trunk, bag, purse, parcel, suitcase, or backpack in which domestic articles are contained during travel.

Major and Minor Axes: As used in this disclosure, the major and minor axes refer to a pair of perpendicular axes that are defined within a structure. The length of the major axis is always greater than or equal to the length of the minor axis.

The major axis forms the longest symmetric bifurcation of a structure selected from the group consisting of: a) the structure; or, b) the perimetrical boundary of the structure. The major and minor axes intersect at the center of the structure. The major axis is always parallel or perpendicular to an edge of a rectangular or rectilinear structure.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object.

In a two-dimensional structure, the perimetrical boundary is the rectangle with the minimum surface area.

Pivot: As used in this disclosure, a pivot is a rod or shaft around which an object rotates or swings.

Platform: As used in this disclosure, a platform is an elevated horizontal surface that forms a load path to support objects placed on or suspended from the elevated horizontal surface of the platform.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Open Position: As used in this disclosure, an open position refers to a movable structure that is in an orientation that presents a perimetrical boundary of the movable structure that is greater than the closed position. The open position is often referred to as an object being "open."

Openwork: As used in this disclosure, the term openwork is used to describe a structure, often a surface, which is formed with one or more openings that allow for visibility and fluid flow through the structure. Wrought work and meshes are forms of openwork.

Orientation: As used in this disclosure, orientation refers to the positioning of a first object relative to: 1) a second object; or, 2) a fixed position, location, or direction.

Ring: As used in this disclosure, a ring is a term that is used to describe a disk-like structure through which a negative space is formed through the faces of the disk-like structure. Rings are often considered loops. The negative space formed through the faces of the disk-like structure is called the characteristic aperture.

Rotation: As used in this disclosure, rotation refers to the cyclic movement of an object around a fixed point or fixed axis. The verb of rotation is to rotate.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Textile: As used in this disclosure, a textile is a material that is woven, knitted, braided or felted. Synonyms in common usage for this definition include fabric and cloth. The two surfaces of the textile with the greatest surface area are called the faces of the textile.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Warp: As used in this disclosure, the warp is the set of lengthwise yarns that are held in tension on a frame or loom. Each individual warp thread in a fabric is called a warp end.

Weave: As used in this disclosure, to weave is a verb that means to interlace yarns to form a textile structure. Industrial forms of weaving include, but are not limited to, weaving, braiding, knitting, and twisting. In common usage, the term weaving can be expanded to incorporate cord like 23 structures. For example, the interlacing of hair is commonly called a hair weave. A non-woven textile is a sheeting structure that is formed from yarns or filaments using a process other than weaving.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The shape of a webbing is approximated by a rectangular disk shape. The two surfaces of a webbing with the greatest surface area are called the faces of the webbing.

Weft: As used in this disclosure, the weft is the yarn or yarns that are inserted over and under the warp yarns. In common usage, the weft may also be referred to as the filling yarn or filler.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A luggage rack accessory comprising a folding structure, a woven platform, a luggage item, and a luggage pedestal;

wherein the woven platform attaches to the folding structure to form a load bearing surface;

wherein the luggage pedestal elevates the load bearing surface;

wherein the folding structure rotates between a closed position and an open position;

wherein the folding structure removably mounts on a superior surface of the luggage pedestal in order to support the luggage item;

wherein the woven platform forms a platform that increases the load bearing surface in order to receive the luggage item;

wherein the folding structure comprises a first frame member, a second frame member, and a hinge structure;

wherein the hinge structure fastens the first frame member to the second frame member;

wherein the hinge structure is a rotating device;

wherein the hinge structure forms a locking hinge;

wherein the hinge structure attaches the second frame member to the first frame member such that the second frame member rotates between the closed position and the open position;

wherein the hinge structure locks the folding structure into a fixed position when the folding structure is in the open position;

wherein the luggage pedestal elevates the load bearing surface;

wherein the load bearing surface receives the luggage item;

wherein the load bearing surface transfers the load of the luggage item to the luggage pedestal;

wherein the luggage item is a container used to transport domestic articles during travel;

wherein the luggage pedestal is a mechanical structure;

wherein the luggage pedestal is a load bearing structure;

wherein the folding structure is a mechanical structure;

wherein the folding structure is a load bearing structure:

wherein the folding structure is a collapsible structure;

wherein the folding structure is a rotating structure;

wherein in the closed position, the folding structure rotates to form a composite prism structure;

wherein in the open position, the folding structure rotates to form a lateral structure;

wherein the folding structure forms the framework the woven platform mounts on;

wherein the folding structure transfers the loads of the woven platform and the luggage item to the luggage pedestal;

wherein the first frame member forms a portion of the perimeter of the openwork structure of the folding structure;

wherein the second frame member forms the balance of the perimeter of the openwork structure of the folding structure;

wherein the second frame member attaches to the first frame member such that the second frame member rotates relative to the first frame member:

wherein the second frame member rotates between the closed position and the open position;

wherein the second frame member is geometrically identical to the first frame member;

wherein the second frame member attaches to the first frame member such that the second frame member aligns with the first frame member in the closed position;

wherein the alignment of the second frame member with the first frame member forms the shape of the folding structure in the closed position;

wherein the second frame member attaches to the first frame member such that the second frame member and the first frame member forms a lateral structure in the open position;

wherein the hinge structure further comprises a hinge pin and a hinge latch;

wherein the hinge pin is a pivot;

wherein the hinge pin forms the mechanical structure that secures the second frame member to the first frame member;

wherein the hinge pin provides the mechanism that allows the second frame member to rotate relative to the first frame member;

wherein the hinge latch mechanical structure;

wherein the hinge latch forms a latch that releasably locks the folding structure into the closed position.

2. The luggage rack accessory according to claim 1 wherein the woven platform forms a horizontally oriented load bearing surface;

wherein the woven platform is a woven structure;

wherein the woven platform is an openwork structure;

wherein the woven platform is a load bearing structure;

wherein the woven platform receives the load of the luggage item;

wherein the woven platform transfers the load of the luggage item to the folding structure;

wherein the woven platform is a flexible structure;

wherein the woven platform is a textile based structure;

wherein the woven platform is webbing based structure;

wherein the webbings of the woven platform are interlaced to form the horizontally oriented load bearing surface;

wherein the woven platform is a foldable structure;

wherein the foldable structure of the woven platform allows the woven platform to fold onto itself when the folding structure rotates into the closed position;

wherein the woven platform forms the horizontally oriented load bearing surface when the folding structure rotates into the open position;

wherein the openwork structure of the woven platform encloses the characteristic aperture of the first frame member;

wherein the openwork structure of the woven platform encloses the characteristic aperture of the second frame member.

3. The luggage rack accessory according to claim 2 wherein the woven platform comprises a plurality of major webbing structures and a plurality of minor webbing structures;

wherein each webbing structure selected from the plurality of major webbing structures is a textile based structure;

wherein each webbing structure selected from the plurality of minor webbing structures is a textile based structure.

4. The luggage rack accessory according to claim 3 wherein each webbing structure selected from the plurality of major webbing structures is a flexible structure;

wherein each webbing structure selected from the plurality of major webbing structures is a webbing;

wherein each webbing structure selected from the plurality of major webbing structures is a load bearing structure;

wherein the span of the length of the major axis of each webbing structure selected from the plurality of major webbing structures is identical;

wherein each webbing structure selected from the plurality of major webbing structures is formed with a first free end and a second free end;

wherein the first free end of each webbing structure selected from the plurality of major webbing structures is the edge of the lateral face of the selected webbing structure with the least span of length;

wherein the second free end of each webbing structure selected from the plurality of major webbing structures is the edge of the lateral face of the selected webbing structure that is distal from the first free end;

wherein the first free end of each webbing structure selected from the plurality of major webbing structures attaches to an edge of the perimeter of the folding structure;

wherein the second free end of each webbing structure selected from the plurality of major webbing structures attaches to the edge of the perimeter of the folding structure that is distal from the perimeter edge the first free end attaches to;

wherein the plurality of major webbing structures attach to the folding structure such that the major axes of each webbing structure selected from the plurality of major webbing structures are parallel.

5. The luggage rack accessory according to claim 4 wherein each webbing structure selected from the plurality of minor webbing structures is a flexible structure;

wherein each webbing structure selected from the plurality of minor webbing structures is a webbing;

wherein each webbing structure selected from the plurality of minor webbing structures is a load bearing structure;

wherein the span of the length of the major axis of each webbing structure selected from the plurality of minor webbing structures is identical;

wherein the span of the length of the major axis of each webbing structure selected from the plurality of minor webbing structures is less than the span of the length of the major axis of each webbing structure selected from the plurality of major webbing structures;

wherein each webbing structure selected from the plurality of minor webbing structures is formed with a third free end and a fourth free end;

wherein the third free end of each webbing structure selected from the plurality of minor webbing structures is the edge of the lateral face of the selected webbing structure with the least span of length;

wherein the fourth free end of each webbing structure selected from the plurality of minor webbing structures is the edge of the lateral face of the selected webbing structure that is distal from the third free end;

wherein the third free end of each webbing structure selected from the plurality of minor webbing structures attaches to an edge of the perimeter of a structure selected from the group consisting of: a) the first frame member of the folding structure; and, b) the second frame member of the folding structure;

wherein the fourth free end of each webbing structure selected from the plurality of minor webbing structures attaches to the edge of the perimeter of the selected structure that is distal from the perimeter edge the third free end attaches to;

wherein the plurality of minor webbing structures attach to the folding structure such that the major axes of each webbing structure selected from the plurality of minor webbing structures are parallel.

* * * * *